US007347601B2

(12) United States Patent
Mizushima

(10) Patent No.: US 7,347,601 B2
(45) Date of Patent: Mar. 25, 2008

(54) VEHICLE LAMP UNIT

(75) Inventor: Satoru Mizushima, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 99 days.

(21) Appl. No.: 11/147,464

(22) Filed: Jun. 8, 2005

(65) Prior Publication Data

US 2005/0281044 A1 Dec. 22, 2005

(30) Foreign Application Priority Data

Jun. 9, 2004 (JP) ..... 2004-171512

(51) Int. Cl.
*F21V 8/00* (2006.01)

(52) U.S. Cl. ..... 362/517; 362/545

(58) Field of Classification Search ..... 362/517–519, 362/545, 348, 297

See application file for complete search history.

(56) References Cited

U.S. PATENT DOCUMENTS 4,208,704 A * 6/1980 Draper ..... 362/518
5,926,329 A * 7/1999 Yamamoto et al. ..... 359/869
6,341,885 B1 * 1/2002 Futami et al. ..... 362/518
6,626,565 B2 * 9/2003 Ishida ..... 362/514
7,070,301 B2 * 7/2006 Magarill ..... 362/241
2004/0208018 A1 * 10/2004 Sayers et al. ..... 362/544

FOREIGN PATENT DOCUMENTS

JP 2000-276905 A 10/2000
JP 2001-84810 A 3/2001
JP 2002-270009 A 9/2002

* cited by examiner

*Primary Examiner*—Jong-Suk (James) Lee
*Assistant Examiner*—Julie A Shallenberger
(74) *Attorney, Agent, or Firm*—Foley & Lardner LLP

(57) ABSTRACT

A vehicle lamp unit includes an LED having a high directivity as a light source and a reflective surface that reflects a light from the LED. The reflective surface is based on a paraboloid of revolution with the LED as a focal point, and divided into a plurality of reflecting portions, including a plurality of first reflective surfaces that reflects light beams within a half-value angle in a first predetermined direction, and a plurality of second reflective surfaces that reflects light beams out of the half-value angle in a second predetermined direction. A focal length of the paraboloid of revolution for the first reflective surfaces is smaller than that of the paraboloid of revolution for the second reflective surfaces.

5 Claims, 6 Drawing Sheets

VEHICLE LAMP UNIT

CROSS-REFERENCE TO RELATED APPLICATIONS

The present document incorporates by reference the entire contents of Japanese priority document, 2004-171512 filed in Japan on Jun. 9, 2004.

BACKGROUND OF THE INVENTION

1. Field of the Invention

The present invention relates to a vehicle lamp unit such as a stop lamp, and, more particularly, to a vehicle lamp unit that uses a light emitting diode (LED) having a high directivity as a light source.

2. Description of the Related Art

The vehicle lamp unit using LEDs as a light source is getting popular recently. However, because an ordinary LED has a high directivity, a light emission range of one LED is extremely narrow. Consequently, the vehicle lamp unit requires a number of LEDs to satisfy light distribution specifications such as an amount of light (intensity and luminance), which increases manufacturing costs of the vehicle lamp unit.

Some vehicle lamp units are developed to satisfy the light distribution specifications with less number of LEDs by widening the light emission range of the LED. This type of vehicle lamp unit is disclosed, for example, in Japanese Patent Application Laid-Open No. 2000-276905 and Japanese Patent Application Laid-Open No. 2002-270009. FIGS. 1A to 1C are schematics for explaining a conventional vehicle lamp unit. The conventional vehicle lamp unit has an LED 100 having a high directivity as a light source and a reflective surface 101 that reflects light beams L3 emitted from the LED 100 in a predetermined direction.

When the LED 100 emits a light, the light beams L3 from the LED 100 are reflected by the reflective surface 101 in a predetermined direction. Light beams L4 reflected at the reflective surface 101 are radiated to the outside with a predetermined light distribution pattern. The conventional vehicle lamp unit is configured to satisfy the light distribution specifications with less number of LEDs 100 by using the reflective surface 101.

The shape of the reflective surface 101 based on a single paraboloid of revolution to satisfy a light distribution with less number of LEDs 100. In order to clear conditions on the amount of light to satisfy the light distribution specifications and conditions on less number of light sources (LEDs 100), the conventional vehicle lamp unit is required to make effective use of the light beams L3 emitted from the light sources (LEDs 100). Therefore, by using the reflective surface 101, the conventional vehicle lamp unit effectively uses the light beams L4 obtained by reflecting the light beams L3 from the light sources (LEDs 100) at the reflective surface 101.

However, if the LED 100 having a high directivity is used as the light source, an F value (focal length) of the paraboloid of revolution for the reflective surface 101 becomes smaller than usual. Therefore, with the conventional vehicle lamp unit, a range of the light beams L4 reflected from the reflective surface 101, i.e., a light emission range of the reflective surface 101, is limited to some extent, and therefore, it is not possible to expand the light emission range.

Outside dimensions A and B of the reflective surface 101 based on the single paraboloid of revolution when viewed from a front side are restricted by a depth C of the reflective surface 101. In other words, there is a correlation between opening dimensions A and B of the paraboloid of revolution and the depth C. Then, the depth C of the reflective surface 101 is restricted by the F value of the paraboloid of revolution for the reflective surface 101.

For example, when aluminum is evaporated onto the reflective surface 101, there is a correlation between the depth C of the reflective surface 101 onto which aluminum can be evaporated and the F value of the paraboloid of revolution for the reflective surface 101. The F value thereof becomes small when the LED 100 having a high directivity is used as the light source. As a result, restriction of the F value causes the depth C of the reflective surface 101 to be small.

Furthermore, the outside dimensions A and B of the light emission range of the reflective surface 101 are restricted to be small by the restriction of the depth C to be small. The light emission range of the reflective surface 101 of FIG. 1A to FIG. 1C is a circle inscribed in a rectangle i.e. an almost square (A=B) of an outside dimension width A and an outside dimension length B.

In addition, the shape of the light emission range of the reflective surface 101 is an almost circle. If the light emission range of the reflective surface 101 is a rectangle or an almost square inscribed in the circle, it is necessary to form a straight wall D in the reflective surface 101 by cutting the paraboloid of revolution for the reflective surface 101, as shown in FIG. 1C. In this case, dimension E of the rectangular light emission range becomes smaller than the dimensions A and B of the light emission range that is the almost circle circumscribing the rectangle. As explained above, the conventional vehicle lamp unit has the problems such that the light emission range of the reflective surface 101 is limited to some extent, which causes the light emission range not to be widened.

SUMMARY OF THE INVENTION

It is an object of the present invention to at least solve the problems in the conventional technology.

A vehicle lamp unit according to one aspect of the present invention includes an LED having a high directivity as a light source; and a reflective surface that reflects a light from the LED in a predetermined direction, having a configuration based on a paraboloid of revolution with a position of the LED as a focal point, and divided into a plurality of reflecting portions, including a plurality of first reflective surfaces that reflects first light beams within a half-value angle, from among the light from the LED, in a first predetermined direction, to satisfy light distribution specifications, and a plurality of second reflective surfaces that reflects second light beams out of the half-value angle, from among the light from the LED, in a second predetermined direction, and widens a light emission range to adjust a shape of the light emission range. A focal length of the paraboloid of revolution for the first reflective surfaces is smaller than a focal length of the paraboloid of revolution for the second reflective surfaces.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a vehicle lamp unit according to the present invention are explained in detail below with reference to the accompanying drawings. It should be noted that the present invention is not limited by the embodiments.

Figure 2:
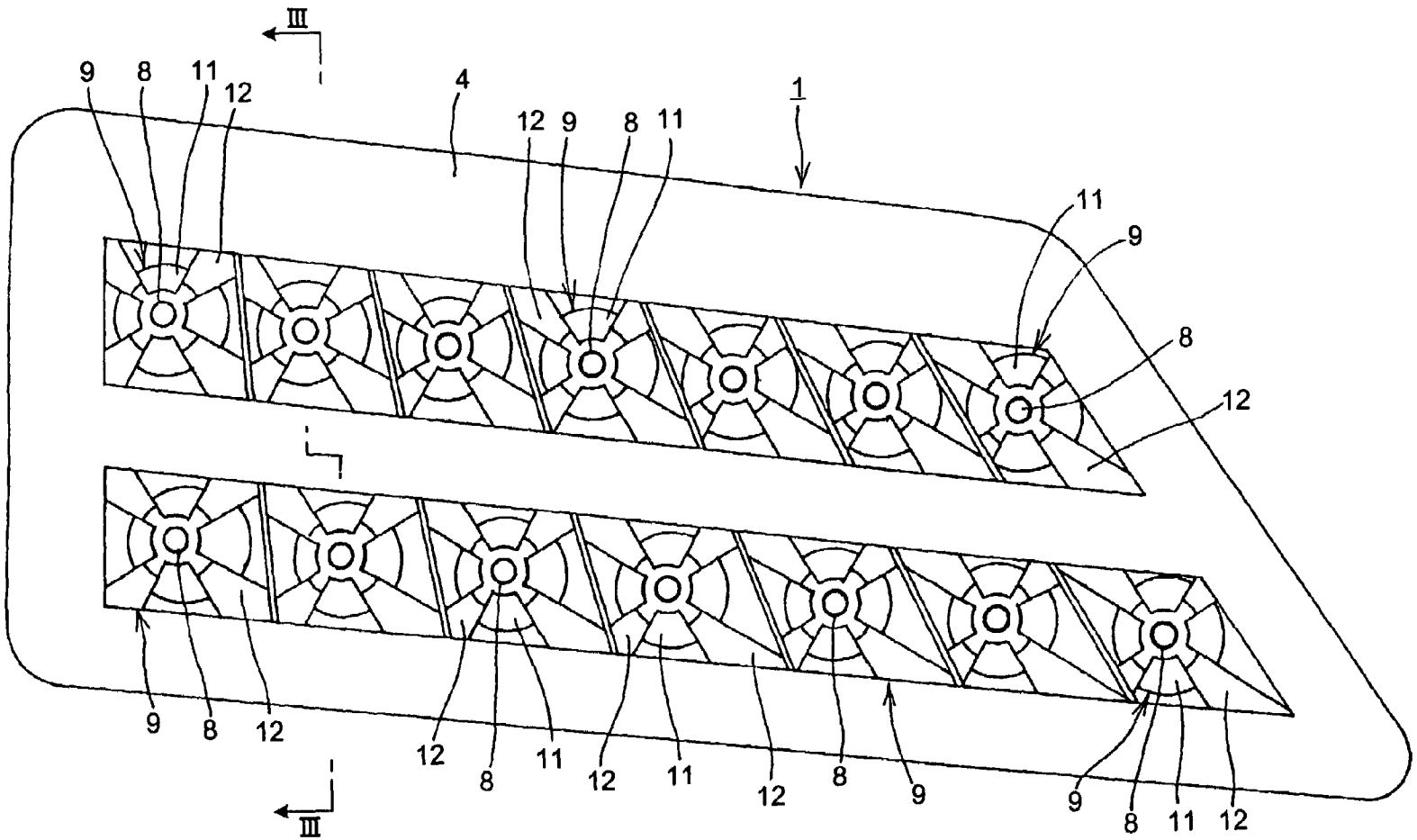
FIG. 2 is a front view of a vehicle lamp unit according to an embodiment of the present invention.
Figure 3:
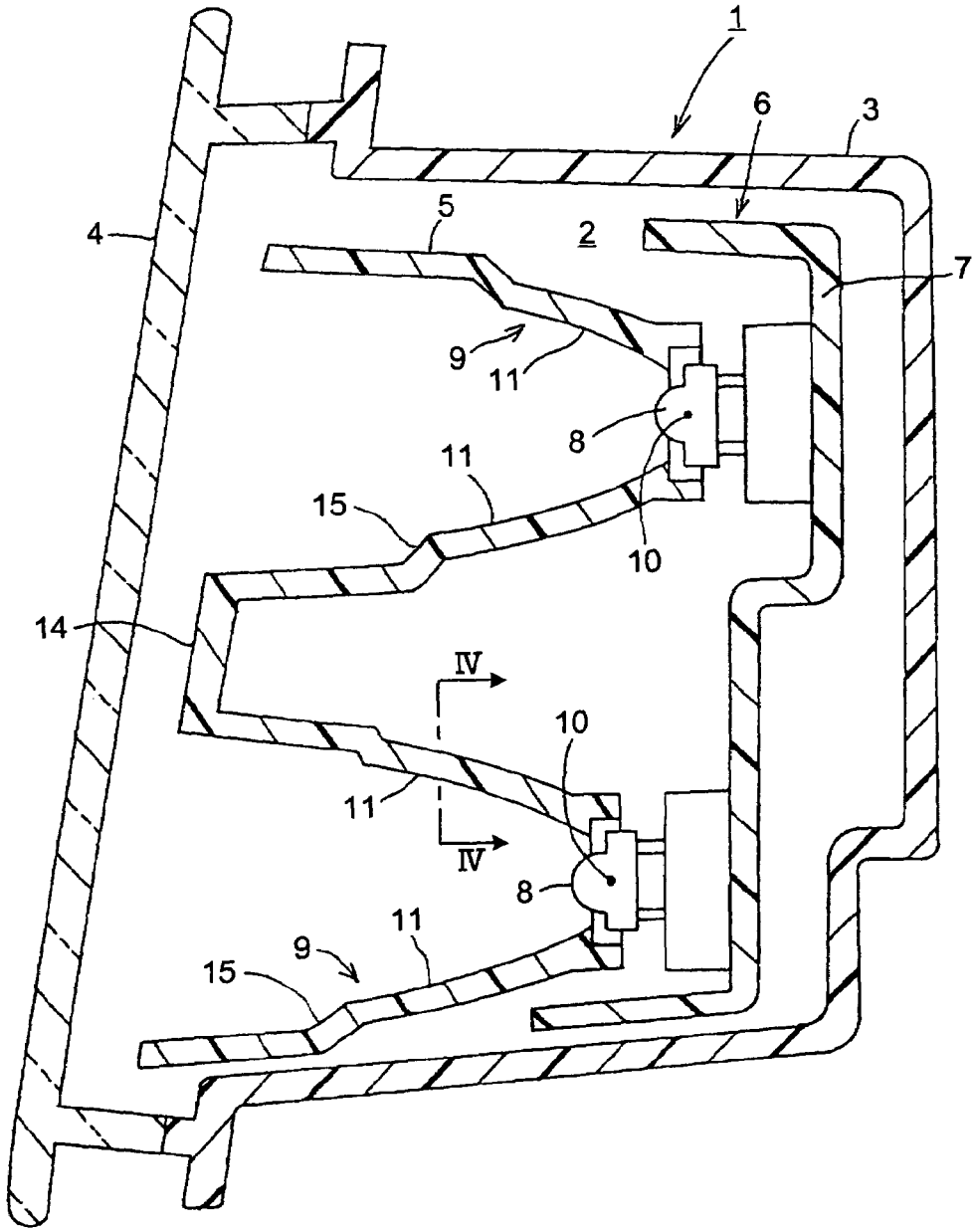
FIG. 3 is a cross section of the vehicle lamp unit taken along a line III-III of FIG. 2.

FIG. 2 is a front view of a vehicle lamp unit according to an embodiment of the present invention. FIG. 3 is a cross section of the vehicle lamp unit taken along a line III-III of FIG. 2. A stop lamp 1, as the vehicle lamp unit according to the present embodiment, includes a lamp housing 3 and a lamp lens 4 that form a lamp room 2, and an inner housing 5 (inner panel, reflector) and an LED assembly 6 that are arranged in the lamp room 2.

The stop lamp 1 can be a combination lamp combined with other vehicle lamp units such as a turn signal lamp and a backup lamp. The lamp lens 4 is, for example, a plain outer lens. The inner housing 5 is fixed to the lamp housing 3 by a screw or so. The LED assembly 6 is fixed to the lamp housing 3 and/or the inner housing 5 by a screw or so. An inner lens may be arranged inside the lamp lens 4 (in the lamp room 2 side).

Figure 5:
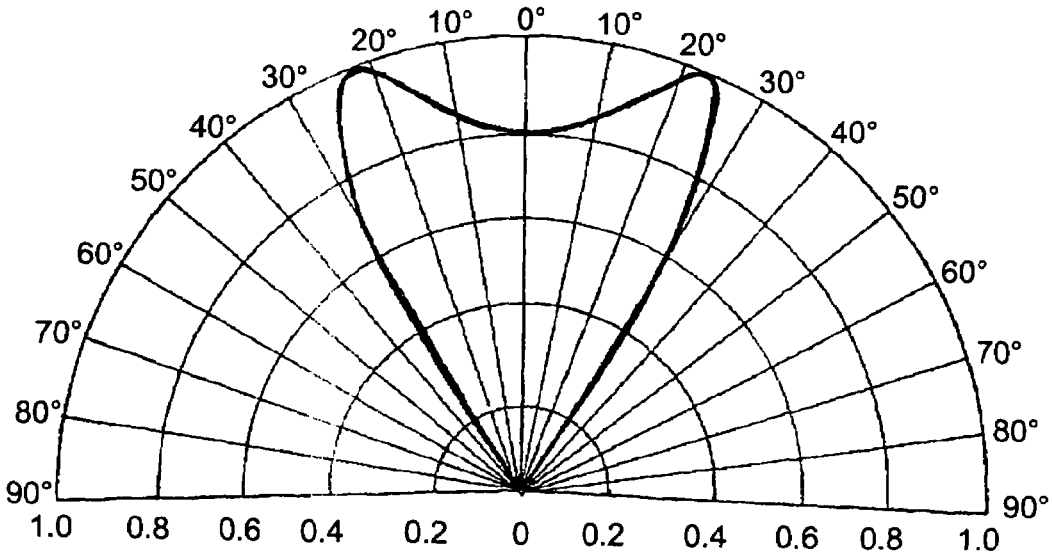
FIG. 5 is a diagram for explaining a directivity of an LED.

The LED assembly 6 includes a holder 7 and a plurality of LEDS 8 fixed to the holder 7. As shown in FIG. 2, 14 units of the LEDs 8 in total are arranged in such a manner that two rows are vertically provided and each of the rows has seven units of the LEDs 8. The LED 8 is an ordinary and standard LED and has high directivity as shown in FIG. 5. More specifically, a half-value angle of the LED 8 is an angle between an axis of the LED 8 and a direction for which the light emitted from the LED 8 has an intensity value one half of a maximum intensity value, and may be about 30 degrees to 35 degrees with respect to the axis of 0 degrees. The LED 8 may be any LED having high directivity other than the high directivity.

A reflective surface 9 is provided in the inner housing 5. As shown in FIG. 2 and FIG. 3, 14 units in total of the whole reflective surfaces 9 are arranged correspondingly to the 14 units of LEDs 8. The 14 units are arranged in the top and bottom two rows each of which has seven units. The reflective surface 9 is formed by subjecting the surface of the inner housing 5 to aluminum evaporation or silver coating. The reflective surface 9 is formed with reflective surfaces based on paraboloids of revolution in which a position of a light emitting point 10 of the LED 8 is set as an almost focal point.

Figure 6B:
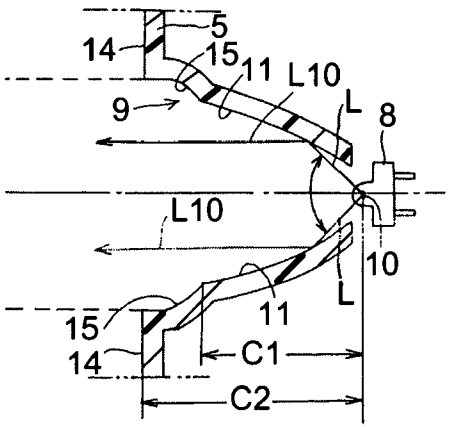
FIGS. 6A to 6C are schematics of a single unit of the vehicle lamp unit according to the present embodiment.
Figure 6A:
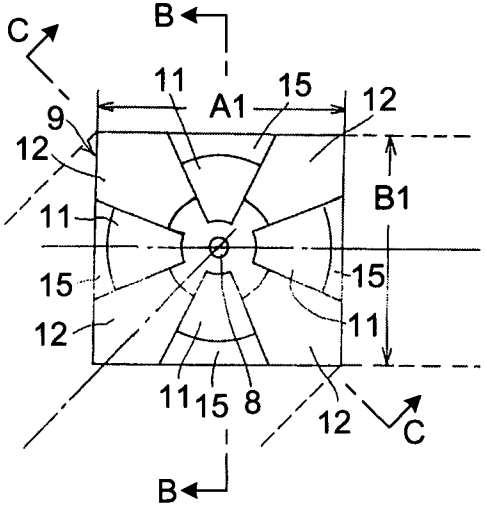

A front view of the reflective surface 9 is almost equivalent to a front view shape of the light emission range, and indicates an almost quadrangle such as an almost rectangle as shown in FIG. 6A, an almost rhombus as shown in FIG. 2, and an almost trapezoid. The reflective surface 9 having the almost rectangle of FIG. 6A is explained below. In other words, the reflective surface 9 is an almost rectangle of an outside dimension width Al and an outside dimension length B1. The reflective surface 9 is divided into a plurality of parts, eight parts in this example, radially from the LED 8 as a center thereof. The reflective surface 9 having the eight parts divided includes four parts of first reflective surfaces 11 that reflect mainly light beams L within the half-value angle, out of the light from the LED 8, in predetermined directions, and satisfy the light distribution specifications. The reflective surface 9 also includes four parts of second reflective surfaces 12 that reflect mainly light beams L2 that are outside the half-value angle, out of the light from the LED 8, in predetermined directions to widen the light emission range, and adjust the shape of the light emission range to an almost rectangle.

An F value of the paraboloid of revolution for the four first reflective surfaces 11 is smaller than an F value of the paraboloid of revolution for the four second reflective surfaces 12. The four first reflective surfaces 11 and the four second reflective surfaces 12 are alternately arranged. More specifically, the four first reflective surfaces 11 are arranged correspondingly to the four sides of the rectangle, respectively, and the four second reflective surfaces 12 are arranged correspondingly to the four corners of the rectangle, respectively.

Figure 4:
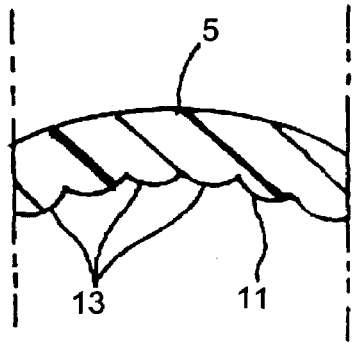
FIG. 4 is a cross section of the vehicle lamp unit taken along a line IV-IV of FIG. 3.

The four first reflective surfaces 11 each have a light diffusing portion 13 that diffuses and reflects the light beams L from the LED 8. As shown in FIG. 4, the light diffusing portion 13 has a plurality of small semi-cylindrical projections.

A joint portion 15 is provided between each of the four first reflective surfaces 11 and an edge of a rectangular opening of the reflective surface 9 (a straight wall 14 of the inner housing 5). More specifically, a depth C1 of the first reflective surface 11, in which the F value of the paraboloid of revolution is smaller than the other, is shorter than a depth C2 of the second reflective surface 12, in which the F value of the paraboloid of revolution is greater than the other. If the depth of the reflective surface 9 is made to fit the depth C2 of the second reflective surface 12, as shown in FIG. 6B, a gap occurs between the depth C1 of the first reflective surface 11 and the depth C2 of the second reflective surface 12. The joint portion 15 is used to fill the gap between the depth C1 and the depth C2.

In the stop lamp 1, one unit of the whole reflective surface 9 and one unit of the LED 8 are set as one set unit. The one unit of the whole reflective surface 9 is divided into the eight parts including the four parts of first reflective surfaces 11 and the four parts of second reflective surfaces 12. The stop lamp 1 includes 14 set units in total arranged in such a manner that two rows are provided vertically and each of the rows has seven set units.

The vehicle lamp unit according to the embodiment is configured in the above manner, and functions and effects thereof are explained below.

At first, in the stop lamp 1, when the LED 8 is lit and emitted, mainly the light beams L within the half-value angle of the light from the LED 8 are reflected by the four first reflective surfaces 11, in which the F value of the paraboloid of revolution is smaller than the other, in predetermined directions, and are diffused by the light diffusing portion 13 in predetermined directions. Light beams reflected L10 diffused pass through the lamp lens 4 to be radiated to the outside with a predetermined light distribution pattern. This radiation allows the light distribution specifications to be satisfied. On the other hand, mainly the light beams L2 that are outside the half-value angle of the light from the LED 8 are reflected by the four second reflective surfaces 12 in predetermined directions, and light beams reflected L20 pass through the lamp lens 4 to be radiated to the outside with a predetermined light distribution pattern. This radiation allows the light emission range to be enlarged and the shape of the light emission range to be adjusted. More specifically, by the reflections of the four second reflective surfaces 12 corresponding to the four corners of the rectangle, the light emission range can be made wider to the rectangle, and every one of the four corners of the rectangular light emission range can be made to illuminate. Consequently, the stop lamp 1 allows brilliant illumination of the rectangular light emission range.

In the stop lamp 1, the light emission range of the reflective surface 9 can be enlarged to some extent in the above manner, and the shape of the light emission range of the reflective surface 9 can be adjusted to an arbitrary shape other than a circle. For example, as shown in FIG. 6A to FIG. 6C, the light emission range of the reflective surface 9 is an almost rectangle of the outside dimension width A1 and the outside dimension length B1 by the reflections of the four first reflective surfaces 11 and the reflections of the four second reflective surfaces 12.

Figure 1B:
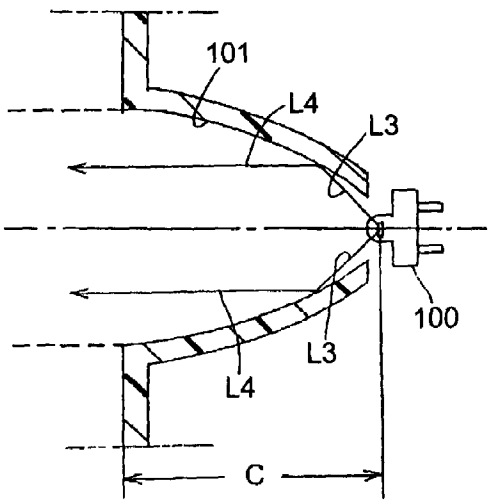
FIGS. 1A to 1C are schematics for explaining a conventional vehicle lamp unit.
Figure 1A:
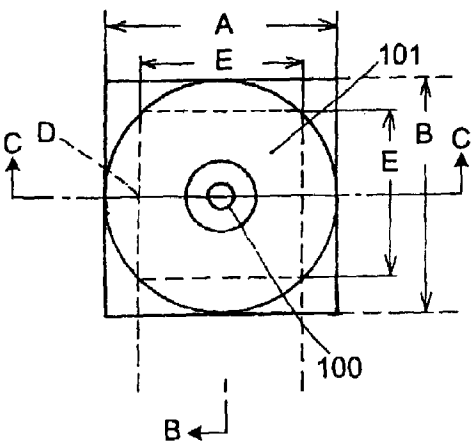
Figure 1C:
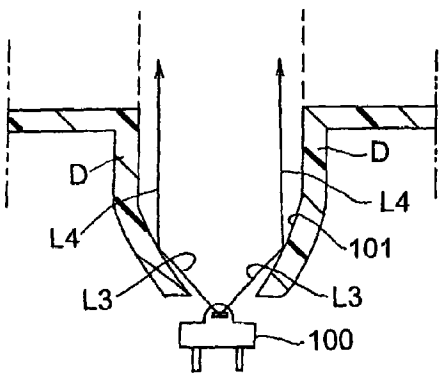
Figure 6C:
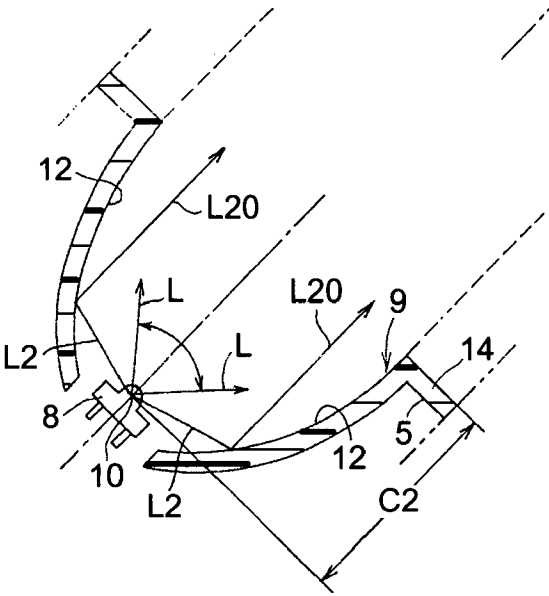

The outside dimension width A1 and the outside dimension length B1 of the rectangular light emission range as shown in FIG. 6A to FIG. 6C are greater than the diameter of the first reflective surface 11. This is because the depth C2 of the second reflective surface 12, in which the F value of the paraboloid of revolution is greater than the other, is longer than the depth C1 of the first reflective surface 11, in which the F value of the paraboloid of revolution is smaller than the other. Moreover, the diameter of the first reflective surface 11 is almost equivalent to the diameter of the circular light emission range of the conventional vehicle lamp unit as shown in FIG. 1A to FIG. 1C.

With these features, the stop lamp 1 can provide a light emission range wider than the light emission range of the conventional vehicle lamp unit. Moreover, the stop lamp 1 can adjust the light emission range to an almost rectangle, while the conventional vehicle lamp unit has the circular light emission range.

The joint portion 15 of the reflective surface 9 is used to fill the gap between the depth C1 of the first reflective surface 11 and the depth C2 of the second reflective surface 12, the gap occurring caused by a difference between the F value of the paraboloid of revolution for the first reflective surface 11 and the F value of the paraboloid of revolution for the second reflective surface 12. Therefore, the joint portions 15 do not contribute to light distribution. However, the joint portions 15 are seen shiny by the diffusions and reflections of the first reflective surfaces 11 and by the reflections of the second reflective surfaces 12. With these features, the whole reflective surface 9 is seen shiny almost rectangularly.

Figure 7:
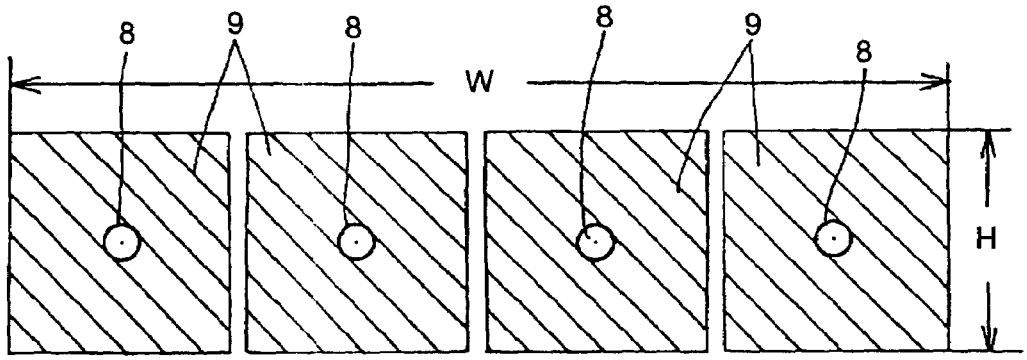
FIG. 7 is a schematic of a light emission portion into which a plurality of units are integrated.
Figure 8:
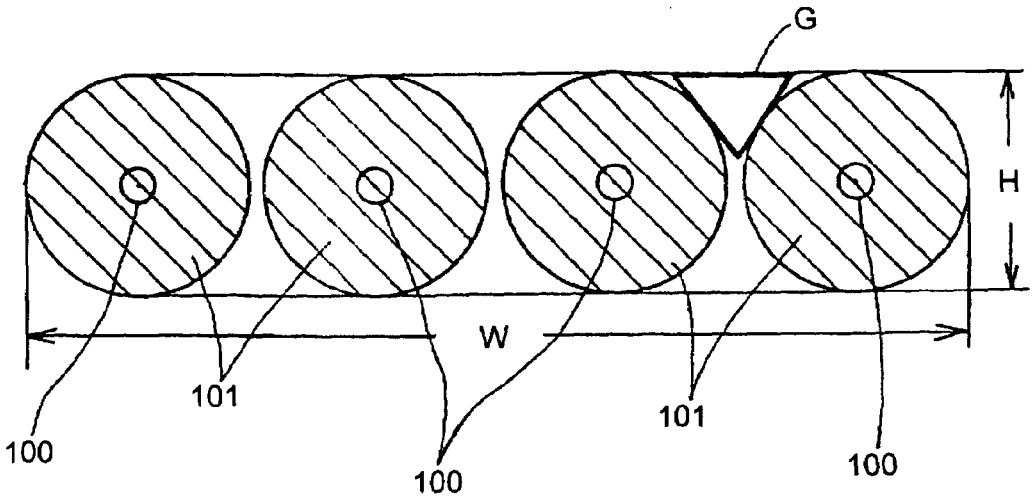
FIG. 8 is a schematic of a light emission portion into which a plurality of units according to the conventional technology is integrated.

As shown in FIG. 2, particularly in the stop lamp 1, one unit of the reflective surface 9 and one unit of the LED 8 are set as one set unit. The one unit of the reflective surface 9 is divided into the eight parts including the four parts of the first reflective surfaces 11 and the four parts of the second reflective surfaces 12. The stop lamp 1 includes the 14 set units in total arranged in such a manner that the two rows are vertically arranged and each of the rows has seven set units. Therefore, when the LEDs 8 in the whole set units are lit to emit light, the seven set units aligned in a row are integrated into a light emission portion. For example, as shown in FIG. 7, alignment of the four set units in a row allows configuration of the light emission portion into which the four set units are integrated. This light emission portion is a lateral rectangle of an outside dimension width W and an outside dimension height H. However, in the case of the conventional vehicle lamp unit in which four set units (each unit includes one LED 100 and one reflective surface 101) are aligned in a row, as shown in FIG. 8, an almost triangular non-light emission portion G is formed in an upper part and a lower part between each adjacent set units, which makes it impossible to configure a light emission portion into which a plurality of set units are integrated.

The stop lamp 1 allows four of the first reflective surfaces 11 to satisfy the light distribution specifications, and allows four of the second reflective surfaces 12 to widen the light emission range and adjust the shape of the light emission range. Therefore, there is no need to perform light distribution control in the lamp lens 4. Thus, the stop lamp 1 is suitable for the lamp lens 4 (outer lens) that is plain.

According to the present embodiment, the stop lamp 1 has been explained. However, the present invention can be applied to any lamp (vehicle lamp unit) other than the stop lamp 1.

Furthermore, according to the present embodiment, the light emission range of the reflective surface 9 is the almost rectangle as shown in FIG. 6A, or the almost rhombus as shown in FIG. 2 or the almost trapezoid. According to the present invention, however, the light emission range of the reflective surface 9 may be any shape such as a pentagon, a hexagon, and an octagon, other than the rectangle and the rhombus.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A vehicle lamp unit comprising:

a light emitting diode having a high directivity as a light source; and a reflective surface that reflects a light from the light emitting diode in a predetermined direction, having a configuration based on a paraboloid of revolution with a position of the light emitting diode as a focal point, and divided into a plurality of reflecting portions, the reflective surface including a plurality of first reflective surfaces that reflect first light beams within a half-value angle, from among the light from the light emitting diode, in a first predetermined direction, to satisfy light distribution specifications; and a plurality of second reflective surfaces that reflect second light beams out of the half-value angle, from among the light from the light emitting diode, in a second predetermined direction, and widen a light emission range to adjust a shape of the light emission range, wherein a focal length of the paraboloid of revolution for the first reflective surfaces is smaller than a focal length of the paraboloid of revolution for the second reflective surfaces, wherein a shape of a front view of the reflective surface is substantially equivalent to a shape of a front view shape of the light emission range, which is substantially rectangular, the reflective surface is divided into the first reflective surfaces and the second reflective surfaces radially from the light emitting diode as a center of the reflective surface, the first reflective surfaces and the second reflective surfaces are arranged alternately, with the first reflective surfaces corresponding to four sides of a rectangle and the second reflective surfaces corresponding to four corners of the rectangle.

2. The vehicle lamp unit according to claim 1, wherein the vehicle lamp unit is formed with a plurality of subunits, and each of the subunits is formed with one reflective surface and one light emitting diode.

3. The vehicle lamp unit according to claim 1, wherein each of the first reflective surfaces includes a light diffusing portion that diffuses and reflects the light from the light emitting diode.

4. The vehicle lamp unit according to claim 1, wherein a joint portion is provided between an edge of the reflective surface and each of the first reflective surfaces, and the joint portion is used to fill a gap between a depth of the first reflective surfaces and a depth of the second reflective surfaces.

5. The vehicle lamp unit according to claim 1, wherein the first and second reflective surfaces are arranged alternately in an azimuthal direction about an axis of the light emitting diode.

* * * * *